United States Patent [19]

Smith et al.

[11] B 3,982,213

[45] Sept. 21, 1976

[54] MONOLITHIC RECIPROCAL LATCHING FERRITE PHASE SHIFTER

[75] Inventors: Peter W. Smith; An-Hwa Soong, both of Westport, Conn.

[73] Assignee: United Technologies Corporation, Hartford, Conn.

[22] Filed: Apr. 16, 1975

[21] Appl. No.: 568,770

[44] Published under the second Trial Voluntary Protest Program on February 10, 1976 as document No. B 568,770.

[52] U.S. Cl. ..... 333/31 A; 333/21 A; 333/24.1

[51] Int. Cl.[2] ..... H01P 1/18

[58] Field of Search ..... 333/24.1, 31 A

[56] References Cited

UNITED STATES PATENTS

| | | | |
|---|---|---|---|
| 3,626,335 | 12/1971 | Hord et al. | 333/31 A |
| 3,698,008 | 10/1972 | Roberts et al. | 333/24.1 X |
| 3,753,160 | 8/1973 | Safran | 333/31 AX |
| 3,760,300 | 9/1973 | Leahy | 333/31 A |
| 3,845,421 | 10/1974 | Charlton et al. | 333/31 AX |

*Primary Examiner*—Paul L. Gensler
*Attorney, Agent, or Firm*—M. P. Williams

[57] ABSTRACT

A reciprocal latching ferrite phase shifter is fashioned from a single slab of ferrite material, such that the phase shifter comprises a monolithic ferrite structure, providing the overall functional characteristics of the phase shifter through an integrated combination of individual portions of the monolithic structure. The reciprocal function of the monolithic phase shifter assembly is provided through the use of dual non-reciprocal phase shifters connected in parallel, such that separate paths and selected phase shifts of zero to 360° for linearly polarized transverse electric microwaves having operating frequencies in the range of two to 100 GHz, are provided for waves propagating in opposite directions. The non-reciprocal phase shifters are comprised of Faraday rotators having external electromagnetic windings in combination with reciprocal circular polarizers, with the residual magnetism characteristics of the ferrite Faraday rotator providing the latching characteristic, while magnetic circulators and quarter wave matching sections provide directional coupling and impedance matching for the linearly polarized wave in the connecting waveguides.

5 Claims, 6 Drawing Figures

RECTANGULAR WAVEGUIDE 72
RECIPROCAL CIRCULAR POLARIZER 90
FARADAY ROTATOR 100
CIRCULATOR 80
PILL MAGNET 85
RESISTIVE CARD ENERGY ABSORBER 88
QUARTER WAVELENGTH IMPEDANCE MATCHING SECTION 76
120°
120°
A
B
E
70
74
76
78
80
82
83
84
85
86
87
88
90
92
94
96
98
100
102
104
106
108
110
114
116
118
122
71

MONOLITHIC RECIPROCAL LATCHING FERRITE PHASE SHIFTER

BACKGROUND OF THE INVENTION

1. Field of Invention

This invention relates to reciprocal latching ferrite phase shifters, and more particularly to monolithic reciprocal latching ferrite phase shifters.

Description of the Prior Art

As is well known in the state of the art, ferrite phase shifters find their most extensive use in the field of electronically scanned, phased array antenna systems due to their inherent ability to handle high peak and average power levels. Systems which employ separate electronically scanned phased array antennas for the transmit and receive functions, such as a bistatic radar, require a phase shift of the wave in one direction only, and therefore non-reciprocal ferrite phase shifters may be successfully employed. However, more typically a single electronically scanned antenna is used for both the transmit and receive functions as in a monostatic radar system. The use of nonreciprocal ferrite phase shifters in such a monostatic radar system would require the phase shifters to be reset between transmission and reception, causing problems in short range and high PRF systems. Therefore, reciprocal ferrite phase shifters are more desirable, and reciprocal latching ferrite phase shifters have been developed in the prior art such as that described by C. R. Boyd in a paper entitled *A Dual Mode Latching Reciprocal Ferrite Phase Shifter*, published in *IEEE Transactions on Microwave Theory and Techniques*, Vol. MTT-18, No. 12, Dec., 1970, pages 1119–1124.

Some prior art phase shifters have consisted of individual component parts which are mechanically joined through bonding or mechanically mounting, resulting in some instances to physically cumbersome devices. Still other prior art phase shifters have involved intricate construction steps in fabricating the individual components to provide the individual functional characteristics, which result in high manufacturing costs. These two features, large size and high cost, are of critical importance in designing an electronically scanned phased array antenna system which typically comprises 1700 elements in the array, and where each wave conducting element must be provided with its own individual phase shifter.

SUMMARY OF THE INVENTION

The object of the present invention is to provide a low cost, small size, reciprocal latching ferrite phase shifter.

According to the present invention, a reciprocal latching ferrite phase shifter is constructed monolithically from solid ferrite material, such that the integrated structure comprises a pair of identical, non-reciprocal Faraday rotator portions (with coils) which are individually connected on both ends to reciprocal circular polarizer portions producing opposite senses of circular polarization, such that the combination of Faraday rotator and reciprocal circular polarizers comprise a non-reciprocal phase shifter portion, with the two non-reciprocal phase shifter portions being combined in parallel through multi-port circulator portions (having external permanent magnets) at each end which provide directional transmission of the electromagnetic waves through a selected one of the pair of non-reciprocal phase shifter portions in dependence upon the direction of wave propagation. In further accord with the invention, the circular portions have one port integrated with quarter wavelength impedance matching end portions for providing impedance matching between the ferrite phase shifter and the wave transmission element, such as a rectangular waveguide or the like, each quarter wavelength impedance matching end portion having energy absorbing cards embedded in the ferrite to absorb one sense of linearly polarized RF energy, while allowing the desired orthogonal sense to pass with minimal insertion loss. The non-reciprocal phase shifter portions are provided with individual sets of coils wound on or mounted to the Faraday rotator portion, which allows an external energy source to provide a variable intensity magnetic field directed along the axis of the Faraday rotator portion.

The monolithic combination of the Faraday rotator, reciprocal circular polarizer, and circulator portions provide a continuous magnetic path within the monolithic structure, thereby eliminating the need for external magnetic yoke assemblies, and further permitting the entire surface of the monolithic structure to be metalized to form a waveguide. The combination of the metalized surface, and the lack of a requirement for an external yoke to complete the magnetic path, allows the electromagnetic waves to be contained within the monolithic structure, thereby eliminating electromagnetic leakage, reducing wave attenuation, and eliminating potential safety hazards.

The monolithic, reciprocal latching ferrite phase shifter of the present invention features symmetrical geometric characteristics and small size, thereby permitting the phase shifter to be mounted in any horizontal or vertical attitude. In addition, the monolithic phase shifter structure is capable of being produced through a molding and baking process, which lends itself to a simplified, large scale manufacturing process, with a subsequent low manufacturing cost.

These and other objects, features and advantages of the present invention will become more apparent in the light of the following detailed description of a preferred embodiment thereof, as illustrated in the accompanying drawing.

DESCRIPTION OF THE PREFERRED EMBODIMENT

The reciprocal latching ferrite phase shifter of the present invention is comprised of a monolithic solid ferrite structure, having its external surface area metalized to form a ferrite filled waveguide. The overall functional characteristics of the reciprocal latching phase shifter are created through a combination of individual functional components, each component having characteristics which are known in the art, and which through a combination provide the total reciprocal latching phase shift function of the type known in the art. The individual components, however, are combined as an integrated, unitary device within the solid monolithic ferrite structure. The geometric characteristics of the monolithic structure of the invention are illustrated in perspective in FIG. 1, as is described hereinafter, and the overall functional characteristics, comprising the individual functional components in a preferred embodiment of the invention for providing reciprocal, latched selectable phase delays in a microwave radar system employing an electronically scanned phased array antenna, are shown in the illustrative, functional block schematic of FIG. 4.

Figure 4:
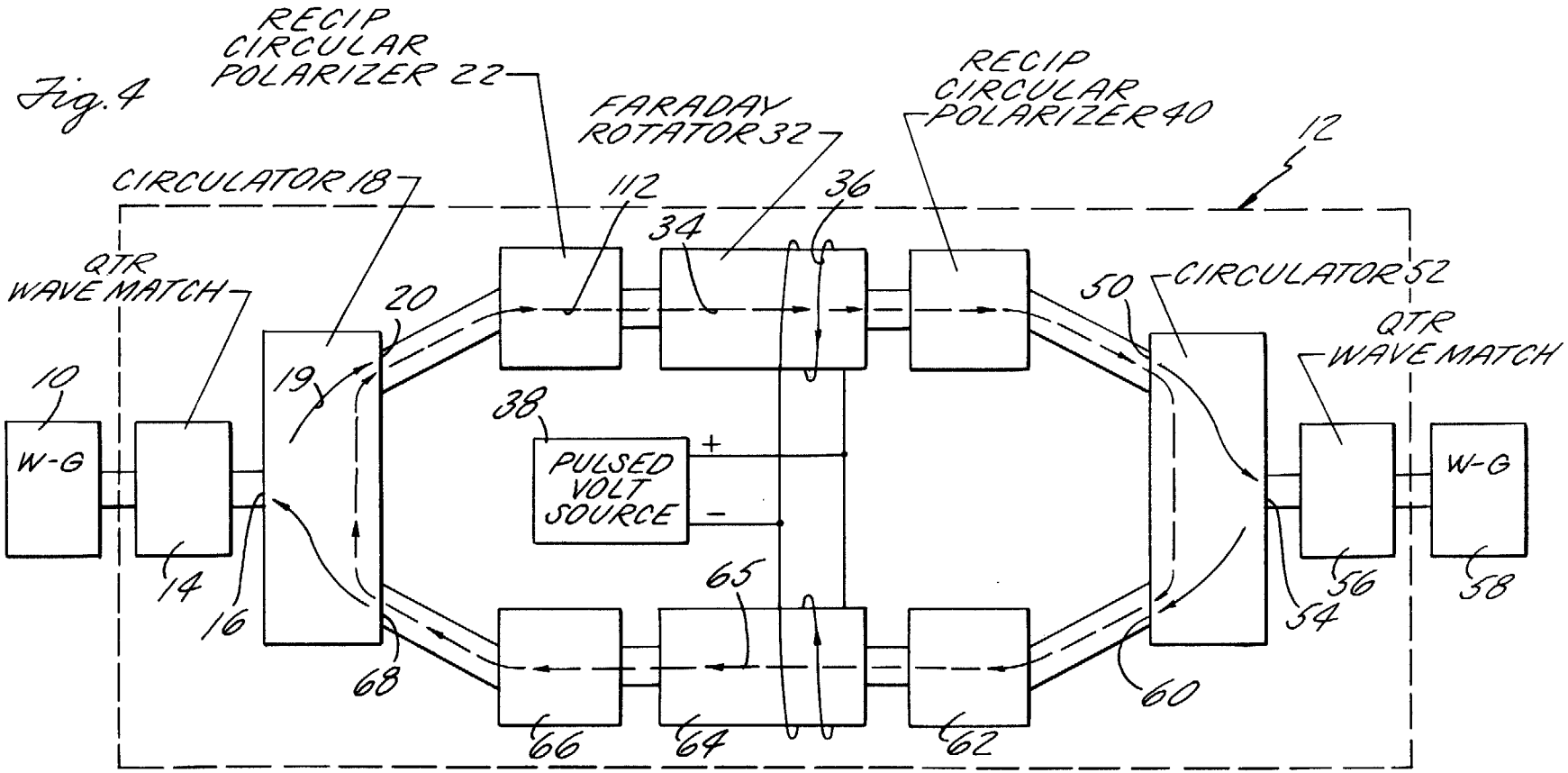
FIG. 4 is a functional block schematic diagram of the preferred embodiment of FIG. 1.

Referring first to FIG. 4, a rectangular hollow waveguide 10 with dimensions suitably selected for transmission of $TE_{10}$ waves having typical operating frequencies in the X band (8 to 12 GHz), is connected on one end to a signal transmitting and receiving means (not shown) and is connected on the other end to the reciprocal latching phase shifter 12 through a quarter wavelength matching portion 14, contained within the total phase shifter structure. The quarter wavelength matching portion 14 is connected to an input port 16 of a three port circulator 18, and provides impedance matching between the hollow waveguide 10 and the solid ferrite core of the phase shifter 12. The port 16 of the circulator 18 is squarely shaped having dimensions typically equal to the smaller dimension of the rectangular waveguide 10. The circulator 18, having functional characteristics well known to those skilled in the art, has a static magnetic field whose magnetic field intensity is directed along an axis transverse to the axis of propagation of the $TE_{10}$ wave propagating from the waveguide 10, and is parallel to the incident $TE_{10}$ electric field (perpendicular to the sheet as viewed in FIG. 4). The circulator 18 directs the wave, as shown by the arrow 19, form the first port 16 to a second port 20 which is connected to a reciprocal circular polarizer 22.

Figure 6:
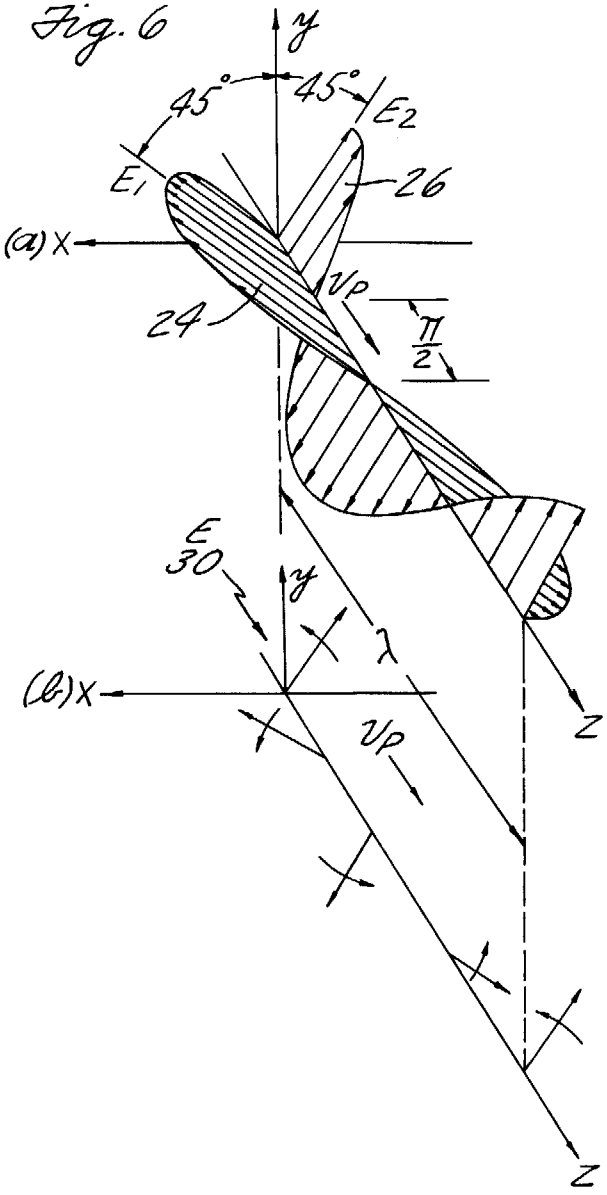
FIG. 6 is an illustration of the components of the instantaneous electric field intensities of a right circularly polarized transverse electric wave.
Figure 5:
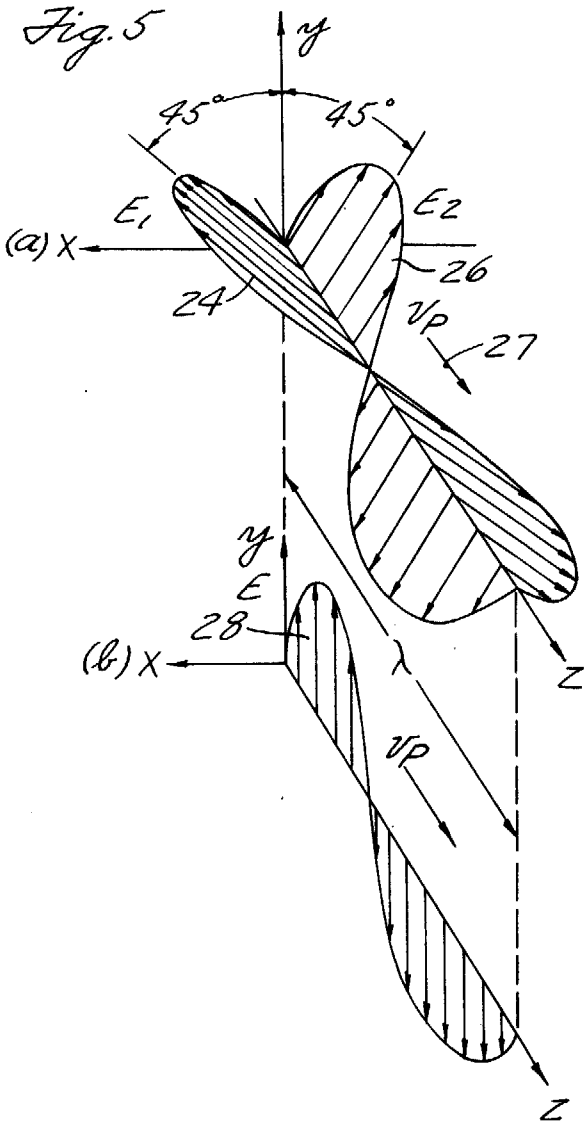
FIG. 5 is an illustration of the components of the instantaneous electric field intensities of a linearly polarized, transverse electric wave.

The functional characteristics of circular polarizers are well known to the art, and are functionally identical to "quarter wave plates" which are used in optics to convert plane light waves into circularly polarized light waves. The reciprocal circular polarizer 22 converts the linearly polarized wave to a circularly polarized wave, rotating in a clockwise direction when viewed along the axis of propagation in the direction of wave travel. This circular polarization of the transverse electric wave permits a Faraday rotator with a variable axial magnetic field to be used as a selectable phase shifter. To demonstrate quantitatively the function of the circular polarizer, the $TE_{10}$ wave at the port 20 may be resolved into two component waves which are orthogonal to each other and directed at an angle of $\pm 45°$ from the linearly polarized wave as shown in FIG. 5, illustration (a). Referring now to FIG. 5, illustration (a), the component waves are defined as $E_1$ 24 and $E_2$ 26, and are represented by vectors describing the electric field intensity of the waves appearing at some instant of time as the wave propagates along the Z axis in the direction illustrated by the phase velocity vector $V_p$27. The $E_1$, $E_2$ component waves 24, 26 are in phase, and the electric field intensity of each wave varies sinusoidally as shown. Vector summation of the individual component waves at increments along the Z axis produces the resultant wave E 28 shown in FIG. 5, illustration (b). The resultant wave E 28, is representative of the linearly polarized $TE_{10}$ wave at some instant of time as it propagates along the Z axis in the direction of the phase velocity vector $V_p$27. The wavelength ($\lambda$) of the E wave is equal to that of the component waves. The circular polarizer 22 creates the clockwise circular polarization of the E wave by providing a differential phase angle between the two component waves, caused by an increase in the wavelength of the component $E_2$ within the circular polarizer portion. For the period in which the component waves propagate through circular polarizer the wavelength of the component wave $E_2$ 26 is increased, creating an increase in the phase velocity ($V_p$) of this component within the circular polarizer. The increase in phase velocity of the $E_2$ component wave 26, creates a differential phase angle between the two component waves, which after propagation of both component waves for a fixed distance within the circular polarizer results in the $E_2$ component wave 26 "leading" the $E_1$ component wave 24 by a phase angle of $\pi/2$ as the component waves emerge from the circular polarizer 22, at which point the $E_2$ component wavelength will be restored to the original value. Referring now to FIG. 6, illustration (a), the component wave $E_2$ 26 is shown "leading" the component wave $E_1$ 24 by a phase angle of $\pi/2$ at some instant of time, as both component waves emerge from the circular polarizer. The vector summation of the component electric field intensity vectors results in an E wave which rotates in the clockwise direction about the Z axis when viewed in the direction of wave propagation, as shown in FIG. 6, illustration (b); the resultant rotating E field 30, which for purposes of clarity is illustrated by a limited number of electric field intensity vectors, rotates through one 360° revolution at an angular velocity ($\omega$) as the wave travels through a distance of one wavelength ($\lambda$) along the Z axis. The clockwise rotation of the E wave 30 is known as right circular polarization (RCP), and as may be easily demonstrated, left circular polarization (LCP) is created by causing an increase in the wavelength of the $E_1$ component wave 24 of FIG. 5, illustration (a), causing the $E_1$ field to lead the $E_2$ by $\pi/2$, thereby creating the opposite direction of rotation.

Referring again to FIG. 4, the RCP wave from the circular polarizer 22 is presented to a Faraday rotator 32. The functionally well known Faraday rotator 32 is used to create (in dependence on the use to which the device is put) the desired amount of phase shift of the incident $TE_{10}$ wave by employing the Faraday rotation principle to modify the angular velocity of the RCP wave. This is accomplished by creating an axial magnetic field 34, directed along the axis of wave propagation, which is variable and whose intensity is controlled by current excitation provided through a set of coils 36 connected to a pulsed voltage source 38. Under the well known Faraday rotation principle, the axial magnetic field ($H_1$) causes the ferrite core to present different values of effective permeability $\mu_{RCP}$, $\mu_{LCP}$, for RCP and LCP waves, which are a function of both the applied magnetic field and the characteristics of the ferrite medidum. As a result, the waves have phase constants $\beta_{RCP} = \omega \sqrt{\epsilon\mu_{RCP}}$; $\beta_{LCP} = \omega \sqrt{\epsilon\mu_{LCP}}$ within the Faraday rotator 32 which differ from the phase constant of the RCP wave within the circular polarizer 22, where $\omega$ is the angular velocity of the wave, and $\epsilon$ is the absolute permitivity of the ferrite. The magnitude of the phase constants $\beta_{RCP}$ and $\beta_{LCP}$ are, therefore, directly proportional to the magnitude of the axial magnetic field. As the RCP wave propagates through the Faraday rotator, the change in phase constant produces a phase delay, such that the total phase delay ($\phi$) experienced by the RCP wave after traveling the length (L) of the Faraday rotator is $\beta_{RCP} \times L$. With a fixed rotator length (L), the phase delay of the RCP wave is set to the desired value by properly controlling the magnetic field $H_1$. Typically, the lenght (L) is equal to a multiple number of operating frequency wavelengths, however design choice governs the selection of length (L), with consideration given to the operating wave frequency, the range of magnetic field intensities, and the desired range of phase shift values.

Initially, a voltage pulse from the source 38 provides a current through the set of coils 36 which causes magnetic saturation of the ferrite core of the Faraday rotator 32, as defined by the particular B-H curve of the device. Removal of the exciting current after some period of time causes a remnant magnetization flux density ($B_R$) to remain within the ferrite core, whose magnitude is known. The remnant magnetization flux density ($B_R$) causes a phase delay of the RCP wave, through the Faraday rotation principle described hereinbefore, known as the "reference insertion phase". Knowing the value of $B_R$, the value of the "reference insertion phase", which may be in the order of tem times the desired range of phase shift values, is also known. Since the existence of a phase shift between two waves is determined by the relative phase of each wave, a system in which each wave experiences the same "reference insertion phase" causes this quantity to cancel. Actual phase shift, therefore, is created by varying the "reference insertion phase" of the respective waves. The phase shifter of the present invention utilizes this principle by establishing the known "reference insertion phase", and consequently the known value $B_R$, as the reference level corresponding to zero phase shift, such that known magnitudes of $\Delta H$ and $\Delta B$ are used to establish new levels of magnetic flux density $B_N$, which are correlated to the desired amount of wave phase shift. Through control of the amplitude and time duration of the voltage source 38, the applied energy results in a known $\Delta H$, and by further knowledge of the particular B-H curve for the device, the new remnant magnetization level ($B_N = B_R - \Delta B$) created after the voltage pulse is removed is also known. The ferrite core remains at the new magnetization level after the voltage pulse is removed, and the Faraday rotator 32 is said to be "latched". The Faraday rotator 32 will remain at the new magnetization level until such a time as a different value of phase shift is desired, in which case the process referred to hereinbefore will be repeared, a new level of magnetization established and a subsequent new value of phase shift.

The output of the Faraday rotator 32 is connected to a second reciprocal circular polarizer 40 which reconverts the RCP wave into a linearly polarized wave, in a manner similar to that of an "analyzer" used in the optic field to convert polarized light waves into plane waves. The circular polarizer 40 presents the phase shifted linearly polarized wave to a port 50 of a second circulator 52, which is identical to the circulator 18, and which directionally transmits the wave to a second port 54. The wave at the port 54 is presented through a second quarter wavelength matching portion 56 to a second hollow rectangular waveguide 58 which may comprise one of a multiplicity of elements of a phased array antenna. The relative phase delay between the multiplicity of transmitted waves determines the angular displacement of the composite wavefront of the phase array antenna from the antenna true bearing.

Return target waves are received by the antenna and are conducted through the waveguide 58 and the quarter wave portion 56 to the port 54 of the circulator 52, which directionally transmits these reflected waves to its third port 60. The return wave at the port 60 is a $TE_{10}$ wave which is phased shifted from the original transmitted $TE_{10}$ by an amount approximately equal to the phase shift produced by the Faraday rotator 32. The reflected wave is presented to a third reciprocal circular polarizer 62 which converts the wave to an RCP wave and presents it to a second Faraday rotator 64. The Faraday rotator 64 is identical to the rotatory 32, and produces, in the manner described hereinbefore, a phase delay in the return wave which is equal to that of the transmitted wave. The Faraday rotator 64 is connected to a fourth reciprocal circular polarizer 66, which like the circular polarizer 40 functions as an "analyzer" to restore the phase delayed RCP wave to a phase delayed, linearly polarized wave, such that the relative phase delay between the multiplicity of return signals received by the phased array antenna, which are selectively phase shifted through a plurality of phase shifters like the one being described, is approximately zero, thereby reducing to zero the angular displacement of the composite return wavefront. The linearly polarized return wave is presented to a third port 68 of the circulator 18, which directionally transmits the wave to its port 16, and through the matching section 14 to the waveguide 10, where it is received by a suitable receiving means.

Figures 1, 2, 3:
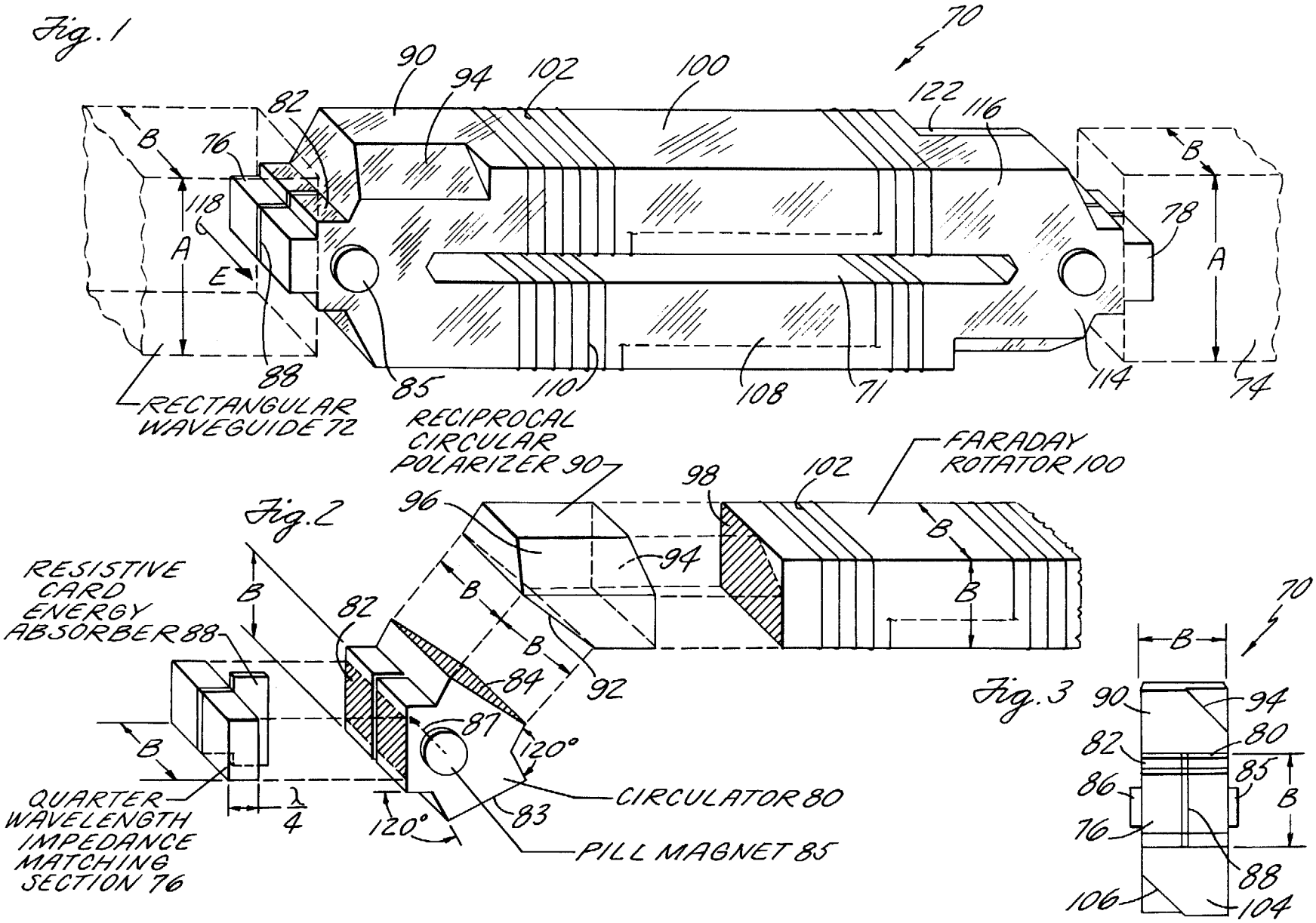
FIG. 1 is a slightly tilted perspective side view of a preferred embodiment of the invention.
FIG. 2 is a partially exploded side view of the major portions of the embodiment of FIG. 1.
FIG. 3 is a perspective end view (tilted slightly downward) of the preferred embodiment of the invention of FIG. 1.

Referring now to FIG. 1, in a preferred embodiment of the reciprocal latching ferrite phase shifter according to the present invention, a monolithic ferrite structure 70 having defined geometric characteristics is constructed in a symmetrical manner, such that the end portions have identical geometric characteristics when viewed along a line perpendicular to the end sections, and such that rotation of the monolithic structure 70 through 180° in the vertical plane, or 180° in the horizontal plane produces a geometric profile identical to that shown. The center of the structure is divided into two distinct solid ferrite portions by an air gap provided by a slot-like rectangular cavity 71 extending through the vertical center of the ferrite structure 70. The monolithic structure 70 is connected on each end to rectangular waveguides 72, 74 having internal dimensions of A, B, with A being the larger dimension. Typically the dimensions A, B of the waveguide, and subsequently the dimensions of the monolithic structure 70, are selected to provide transmission of $TE_{10}$ waves, with operational frequencies within the X band (8 to 12 Gigahertz), however, under proper design criteria the dimensions may be modified to permit transmission of $TE_{10}$ waves with operating frequencies within the range of 2 to 100 Gigahertz. The structure 70 is connected to the waveguides 72, 74 through that section of its end portion which comprises quarter wavelength matching portions 76, 78. The quarter wavelength matching portions 76, 78 provide impedance matching from the hollow waveguides 72, 74 to the monolithic ferrite structure 70, and are themselves solid ferrite portions which are an integral part of the structure 70. These matching portions, having a horizontal dimension typically equal to B of the waveguide, extend into the waveguides 72, 74 in a plane parallel to the horizontal dimension B of the waveguide, and are mounted to the waveguide through a suitable method of bonding. The vertical dimensions of the matching portions 76, 78 are variable, and are dependent upon the characteristic impedances of both the waveguides and the ferrite structure 70 for any given operational frequency, and are selected to satisfy the condition $$Z_M = \sqrt{Z_{WG} \times Z_{ferrite}},$$

where $Z_M$ is the impedance of the quarter wavelength portions 76, 78, $Z_{WG}$ is the impedance of the waveguides 72, 74, and $Z_{ferrite}$ is the impedance of the monolithic ferrite structure 70.

With the exception of the matching portions 76, 78 the entire surface area of the monolithic ferrite structure 70 is metalized to allow the structure 70 to function as a waveguide, preventing leakage of the electromagnetic waves which would otherwise cause attenuation of the wave through the phase shift structure, and a potential safety hazard. The metalization, which is applied to the structure 70 through a process such as electroplating or the like, typically comprises consecutive layers of different elements having the following approximate concentrations: a first layer comprising 100 angstroms (10 Nanometers) of chromium to provide adhesion, a second layer comprising 25 microinches (635 Nanometers) of copper to provide conductivity for the exciting currents, and 5 microinches (127 Nanometers) of gold to prevent oxidation of the conducting layer. The quarter wavelength matching portions 76, 78 are suitably masked to prevent metalization on these surfaces during the process of metalizing the structure 70.

FIG. 2 is a partial perspective, exploded view of the major components of the monolithic structure 70 of FIG. 1. Due to the symmetrical construction of the structure 70 as described hereinbefore, only a limited number of components are shown in FIG. 2. Referring now to FIG. 2, the matching portion 76 is joined to a circulator portion 80 having three ports 82–84. The dimensions of the three ports 82–84 are identical, each being squarely shaped with a dimension typically equal to the B dimension of the waveguide, and are displaced by 120° from each other, such that the extension of the three surfaces forms an equilateral triangle. Two pill magnets are disposed on the ferrite material on each side of the circulator 80, at the approximate geometric center of the equilateral triangle. The pill magnet 85, which in conjunction with a pill magnet 86 located on the opposite side of the circulator (shown in the perspective view of FIG. 3) creates a static magnetic field 87 within the circulator 80 having a magnetic field intensity directed along an axis transverse to the axis of wave propagation. As is well known in the art, the direction of the magnetic field intensity, determines the directional propagation of waves through the circulator, such that for a magnetic field direction as indicated by the arrow 87, propagation will be in a clockwise direction from the port 82. Therefore, incident waves at the port 82 will propagate to the port 84, and incident waves at the port 83 will propagate to the port 82. The quarter wave matching portion 76 is vertically positioned in the center of the port 82, and a resistive card energy absorber 88 is embedded within the matching section 76 and the port 82, at the center of the horizontal B dimension. The resistive energy absorber 88 functions as a resistive element which attenuates any components which are orthogonal to the direction of the $TE_{10}$ wave (i.e., $TE_{01}$ waves which are parallel to the absorber 88), which may be generated due to the discontinuities presented to the incident wave by the juncture of the waveguide 72 and the ferrite structure 70.

The port 84 of the circulator 80 is joined to a reciprocal circular polarizer portion 90. The circular polarizer 90 has a first port 92 which is squarely shaped with a dimension which may typically equal the dimension B of the port 84, and is contiguous to, and aligned with the port 84. The circular polarizer 90 has a second port 94 having a bottom transverse and far side vertical dimension equal to B, but having a near side vertical and top transverse dimension which are truncated to a dimension less than B by a diagonal plane section 96. The horizontal length of the plane section 94, and the degree of truncation are related to the functional aspects of the circular polarizer, and are dependent upon the operational frequency of the $TE_{10}$ wave as is described hereinafter. The port 94 of the circular polarizer 90 is contiguous to and in alignment with a first port 98 of a Faraday rotator portion 100. The port 98 and the body of the Faraday rotator 100 are squarely shaped with a dimension equal to B. The Faraday rotator 100 has a wire assembly 102 wound on, or otherwise mounted in a suitable manner to, the surface of the rotator 100 along the entire length of the section. This wire assembly 102 carries current excitation provided through an external pulsed voltage source to create the axial magnetic field within the Faraday rotator portion, providing the wave phase shift as described hereinbefore.

FIG. 3 is a perspective view (tilted slightly downward) of the left end (as seen in FIG. 1) of the monolithic ferrite structure 70. Referring now to FIG. 3, the matching portion 76 is shown vertically centered on the port 82 of the circulator 80 which has the pill magnets 85, 86 disposed on either side, and with the circular polarizer 90 and its plane section 94 shown in the upper portion of the end section. A symmetrical lower portion is shown with a circular polarizer 104 (not shown in FIG. 2) mounted to the port 83 of the circulator 80 of FIG. 2, and having its cross-section truncated by a plane 106 which is diagonally opposite and parallel to the plane section 94 of the circulator 90.

Referring again to FIG. 1, a Faraday rotator portion 108, identical to the Faraday rotator portion 100 has a wire assembly 110 identically mounted along its length to provide current excitation as described hereinbefore. The two Faraday rotator portions, in combination with the reciprocal circular polarizer and circulator components, provide a continuous path within the monolithic ferrite structure 70 for the axial magnetic fields produced within the respective Faraday rotator portions 100, 108. These two axial magnetic fields are aligned in the same direction along the internal magnetic path as shown in FIG. 4 by the dashed directional line 112. By providing a closed path for the magnetic field of both rotators within the structure 70, the requirement for yoke assemblies extending outside the structure 70 for completion of the magnetic path are eliminated together with the possibility of electromagnetic wave leakage, with the result that the electromagnetic waves are contained within the metalized boundaries of the structure 70, allowing safe operation and preventing attenuation through leakage as mentioned hereinbefore. Due to the symmetry of construction of the monolithic ferrite structure 70 the quarter wavelength matching portion 76, the circulator 80, and the circular polarizer 90 have identical counterparts 78, 114 and 116 respectively at the opposite end of the structure 70. As stated hereinbefore, rotation of the structure 70 through 180° in the vertical plane will produce an identical geometric configuration to that shown in FIG. 1 for the lower half of the structure.

In operation, a $TE_{10}$ wave propagating in the waveguide 72 in a plane parallel to the B dimension, as shown by the E vector 118 in FIG. 1, is received by the quarter wavelength matching portion 76, where any orthogonal components of the $TE_{10}$ wave are attenuated by the energy absorber 88. As described hereinbefore with respect to FIG. 4, the linearly polarized wave is directed through the circulator 80 to the reciprocal circular polarizer 90. The linearly polarized wave E may be resolved into its orthogonal component waves $E_1$, $E_2$ as shown in FIG. 5, illustration (a). The plane 94 of the circular polarizer 90 truncates the squre cross-section of dimension B, such that the diagonal cross-section of the circular polarizer 90 which is normal to the surface of the plane section 94 will have a dimension less than B. The component wave $E_2$ of E has its electric field intensity directed in a plane normal to this reduced diagonal dimension. As a result, the wavelength of the component wave $E_2$ is increased within the region of the truncated cross-section, creating an increased phase velocity for the $E_2$ component, which after propagation through the length of the truncated cross section results in a differential phase angle of $\pi/2$ between the two component waves, as shown in FIG. 6, illustration (a). As described hereinbefore, this results in an RCP wave as illustrated in FIG. 6, illustration (b). The creation of the differential phase angle $\pi/2$ is dependent upon both the degree of truncation of the square cross-section (B), and the length of the truncating plane section along the direction of wave propagation. The values of the respective parameters are governed by considerations given to the operational frequency of the linearly polarized wave and to the simplification of the manufacturing process. Once the degree of truncation (i.e., the amount of reduction in the diagonal dimension) is established and the resultant increased wavelength of $E_2$ is known, the length of the truncating plane may be determined through the expression:

$$\theta = 2\pi D(1/\lambda_{E_1} - 1/\lambda_{E_2})$$

where $\theta$ is equal to the desired phase angle $\pi/2$, $D$ is the length of the truncating plane section, and $\lambda_{E_1}$ and $\lambda_{E_2}$ represent the wavelength of the $E_1$, $E_2$ component waves within the circular polarizer 90.

The RCP wave from the circular polarizer 90 is presented to the Faraday rotator portion 100, where as described hereinbefore before the degree of desired phase delay is created through use of the Faraday rotation principle. The modified RCP wave from the Faraday rotatory 100 is presented to the reciprocal circular polarizer 116 which functions as an "analyzer" to restore the modified RCP wave to a phase shifted linearly polarized wave as described hereinbefore. The circular polarizer 116 reconverts the modified RCP wave to a linearly polarized wave by eliminating the $\pi/2$ differential phase angle between the $E_1$ and $E_2$ component waves. This is accomplished by an increase of the $E_1$ component wavelength within the circular polarizer 116 which it accomplishes by having its diagonal dimension, which is orthogonal to the reduced diagonal dimension of the circular polarizer 100, similarly reduced by the truncating plane section 122 shown in FIG. 1. The reduced diagonal dimension of the circular polarizer 116 is that dimension which is normal to the electric field intensity of the component wave $E_1$, which causes an increase in wavelength and phase velocity of the $E_1$ component and which results in the elimination of the differential $\pi/2$ phase angle. The phase shifted linearly polarized wave from the circular polarizer 116 is directed through the circulator 114 and the quarter wavelength matching portion 78 to the waveguide 74 which may comprise one of a multiple number of elements of the phased array antenna. The return radar signals received from the waveguide 74 are treated in an identical manner through the lower portion of the monolithic ferrite structure 70, comprising the Faraday rotator portion 108, which allows reciprocal operation of the phase shifter.

The overall dimensions of the monolithic structure 70 are dependent upon the frequency of operation of the $TE_{10}$ wave, as stated hereinbefore. Approximate dimensions may be given for a known operating frequency. Therefore, assume that the linearly polarized $TE_{10}$ wave is operating at the center of the X band at 10 Gigahertz. The monolithic ferrite structure 70 comprises ferrite having a typical relative permitivity (or dielectric constant) of 16, with a typical saturation magnetization level of 2500 gauss (0.25 Webers per meter squared) and a residual magnetization of 1,600 gauss (0.16 Webers per meter squared). The dimensions of the rectangular waveguides 72, 74 may typically be $A = 0.9$ inches (2.29 centimeters) and $B = 0.25$ inches (0.635 centimeters), with the square dimensions B of the structure 70 also equal to 0.25 inches (0.635 centimeters). The number of turns within the wire assemblies 102, 110 of the Faraday rotators 100, 108 is approximately 25 to 30 turns for the ferrite described hereinbefore. The overall length of the structure 70 will be on the order of 2.0 inches (5.08 centimeters), with the length of the Faraday rotator portions 100, 108 being equal to approximately one inch (2.54 centimeters).

The monolithic structure of the reciprocal latching ferrite phase shifter of the present invention may be produced through a process of press molding powdered ferrite material with a suitable binder, in a mold having dimensions larger than those of the desired geometric characteristics of the end structure to allow for expected shrinkage in the baking process, and then baking the press molded structure at an approximate elevated temperature of 1400°C for a period of time determined by the size of the structure being produced. This manufacturing process lends itself to large scale quantity production, and subsequent low cost. An alternative, but more costly method of producing the monolithic structure, which may be used for small quantity production, would be the process of machining the geometric characteristics of the phase shifter from a solid piece of ferrite material. While the former process is preferred for large quantity and low cost production, the later process may be desirable for limited, or prototype construction. Similarly, any suitable combination of the two manufacturing methods may be used.

The monolithic reciprocal latching ferrite phase shifter of the present invention features both small physical size and low manufacturing cost, and is ideally suited for phased array antenna systems, typically having 1700 elements, where each of the 1700 elements of the antenna array require a variable phase delayed signal. In addition, the phase shifter of the present invention may find unlimited use throughout the field of microwave transmission where phase shifting may be required, such as in amplitude or phase modulators, as is known to those skilled in the art.

Similarly, although the invention has been shown and described with respect to an illustrative embodiment thereof, it should be understood by those skilled in the art that the foregoing and various other changes, omissions and additions in and to the form and detail thereof may be made therein without departing from the spirit and the scope of the invention.

Having thus described a typical embodiment of our invention, that which we claim as new and desire to secure by Letters Patent is:

1. A reciprocal, latching ferrite phase shifter for providing selectable phase delays to linearly polarized microwaves of electromagnetic radiation propagating between wave transmission waveguides in opposite directions, comprising:

a plurality of electrical coil windings;

a plurality of permanent magnets; and a geometrically symmetrical, monolithic, solid ferrite structure of generally rectangular shape, having a pair of ends of rectangular cross-section and adapted to interface with a related waveguide, said structure having a centrally disposed slot extending transversely entirely through said structure and extending longitudinally along a substantial portion of said structure providing a pair of similar, independent wave transmission paths, one of said windings being disposed around each of said paths and operable in response to voltage pulses applied thereto for latching said paths in a magnetic state, each configuration of winding and path thereby comprising first means for providing a phase shift to waves of circular polarization being transmitted therethrough, each of said paths having portions, at opposite ends of each of said windings, shaped to provide second means for converting waves between plane polarization and circular polarization in a reciprocal fashion, each of said second means of said paths being contiguous to a related one of two further portions, each of said further portions having a pair of said permanent magnets disposed on opposite surfaces thereof to provide a magnetic field transverse to the longitudinal axis of said structure and each further portion being shaped to provide, in combination with said pair of magnets, third means for providing selective, directional propagation of waves such that waves propagating into the respective end of said structure from the related waveguide pass into one of said paths but not into the other of said paths and waves propagating from the other of said paths pass through the respective end of said structure into the related waveguide but not into the other one of said paths.

2. A phase shifter according to claim 1 wherein the entire surface of said structure except said ends have a metalized conductive coating thereon to provide a waveguide means for confining electromagnetic waves internally of the structure.

3. A phase shifter according to claim 1 wherein each end of said structure includes a portion having a reduced size to permit insertion into the related waveguide and of a length chosen to provide a quarter wavelength impedance matching means for providing an impedance to waves propagating therethrough which is between the impedance of the waveguide and that of said circulator means, with respect to said waves.

4. A phase shifter according to claim 3 wherein said impedance matching means includes a longitudinal, electrically resistive plane bisecting said wave matching means in a plane orthogonal to the plane of polarization of the propagating wave, to provide means for absorbing transversely propagating waves in said impedance matching means.

5. A phase shifter according to claim 4 wherein the entire surface of said structure except said quarter wavelength impedance matching portions have a metalized conductive coating thereon to provide a waveguide means for confining electromagnetic waves internally of the structure.

* * * * *